United States Patent [19]

Tulowiecki et al.

[11] Patent Number: 4,756,474

[45] Date of Patent: Jul. 12, 1988

[54] DUCT PRESSURE POWERED AIR VOLUME CONTROLLER

[75] Inventors: David A. Tulowiecki, Liverpool, N.Y.; Richard C. Dreibelbis, Fair Lawn, N.J.

[73] Assignee: Carrier Corporation, Syracuse, N.Y.

[21] Appl. No.: 114,968

[22] Filed: Oct. 30, 1987

[51] Int. Cl.[4] ..... F24F 13/08

[52] U.S. Cl. ..... 236/49; 137/82; 137/489; 236/85

[58] Field of Search ..... 236/49, 85; 137/82, 137/489

[56] References Cited

U.S. PATENT DOCUMENTS

| | | | |
|---|---|---|---|
| 2,767,725 | 10/1956 | Long | 137/82 X |
| 3,006,595 | 10/1961 | Rosebrook | 137/82 X |
| 3,117,723 | 1/1964 | Church | 236/49 C |
| 3,158,320 | 11/1964 | Duncan | 236/85 X |
| 3,186,642 | 6/1965 | Silver | 137/82 X |
| 3,213,613 | 10/1965 | Schwent et al. | 137/82 X |
| 3,225,788 | 12/1965 | Church et al. | 137/489 X |
| 4,245,780 | 6/1981 | Franz | 236/49 C X |
| 4,356,963 | 11/1982 | Edwards et al. | 236/49 C |
| 4,634,047 | 1/1987 | Dean | 236/49 C |

*Primary Examiner*—William E. Tapolcai
*Attorney, Agent, or Firm*—David J. Zobkiw

[57] ABSTRACT

A duct pressure powered air volume controller controls the flow through a terminal responsive to the differential pressure across a nozzle plate, the selected ventilation requirements, and the temperature of the supplied air, the zone and the setpoint.

11 Claims, 4 Drawing Sheets

DUCT PRESSURE POWERED AIR VOLUME CONTROLLER

BACKGROUND OF THE INVENTION

In the heating and cooling of relatively large buildings, a number of problems are encountered. Building codes usually require a predetermined minimum air flow to meet ventilation requirements resulting in the supplying of conditioned air to zones independent of their thermostatic requirements. One result can be overcooling which, typically, exists at the start of a work day. Since thermostatic response would be wrong for heating and the heating would not be fast enough at the minimum flows required for ventilation purposes, a temporary switchover of both the air supply and thermostatic response is necessary. As the various terminals open and/or throttle, the plenum static pressure changes which must also be accounted for in the operation of the controller in order to maintain a stable operation.

SUMMARY OF THE INVENTION

The present invention is directed to a controller which is connected to a duct pressure powered air terminal unit. A pressure drop is sensed in the terminal unit and is related to a specific air flow in the unit. The sensed pressure drop is communicated to the controller as two pressure signals. The controller bleeds one pressure signal so as to control the inflation of a bag or bellows and to thereby modulate the terminal unit to maintain a constant volume air flow through the unit as duct static pressure varies. The controller bleeds the second pressure signal so as to maintain at least a minimum flow through the unit. The amount of the constant volume air flow and the minimum air flow are settable on the controller and may be overridden by a thermostatic input.

It is an object of this invention to provide a duct pressure powered air volume controller.

It is another object of this invention to provide a controller which is suitable for both constant volume and variable air volume control.

It is a further object of this invention to provide a controller which is settable for both a constant volume air flow and for a minimum air flow. These objects, and others as will become apparent hereinafter, are accomplished by the present invention.

Basically a differential pressure is sensed in a terminal unit and used to control the inflation of a bellows or bag. Control of the inflation of the bellows or bag is achieved by controlling the bleeding of one of the sensed pressures. The bleeding of the second one of the sensed pressures can be used to produce a selected minimum flow through the terminal unit.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 2:
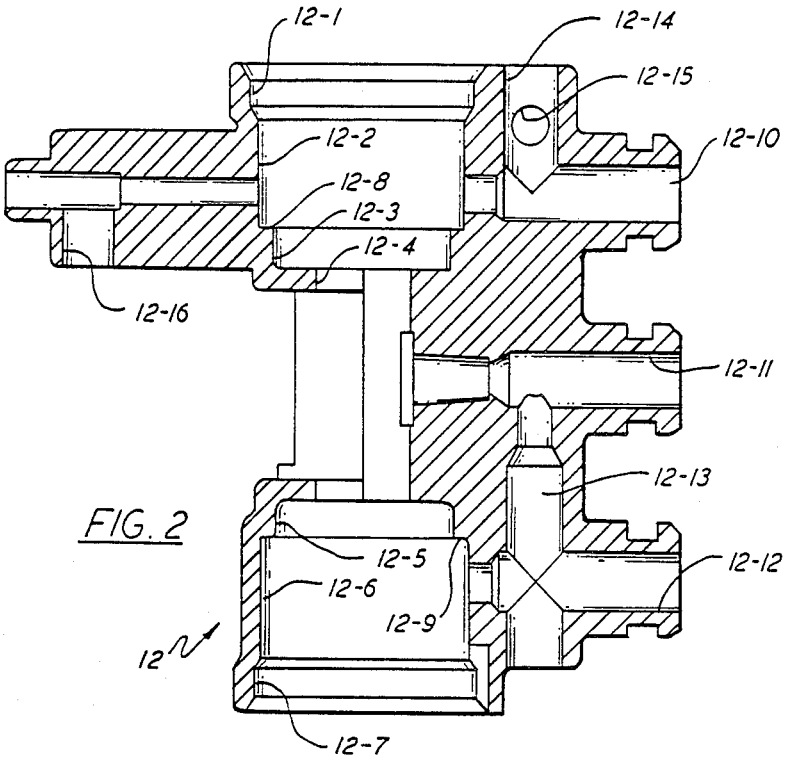
FIG. 2 is a sectional view corresponding to FIG. 1 but showing only the housing of the air volume controller.

In the Figures, the numeral 10 generally designates an air volume controller having a housing 12. Referring specifically to FIG. 2, housing 12 has a bore therein serially defined by bores 12-1 to 12-7. Shoulder 12-8 is formed between bores 12-2 and 12-3 while shoulder 12-9 is formed between bores 12-5 and 12-6. Bore 12-10 defines the low pressure inlet port and transversely intersects bore 12-2. Bore 12-11 defines the bellows port and terminates in bore 12-4. Bore 12-12 defines the high pressure inlet port and terminates in bore 12-6. Bores 12-11 and 12-12 are connected by bore l2-13 which contains bellows orifice 13. Bore 12-14 terminates in bore 12-10 and has a threaded opening 12-15 for receiving threaded adjusting screw 14 which provides an adjustable bleed to the atmosphere.

Figure 1:
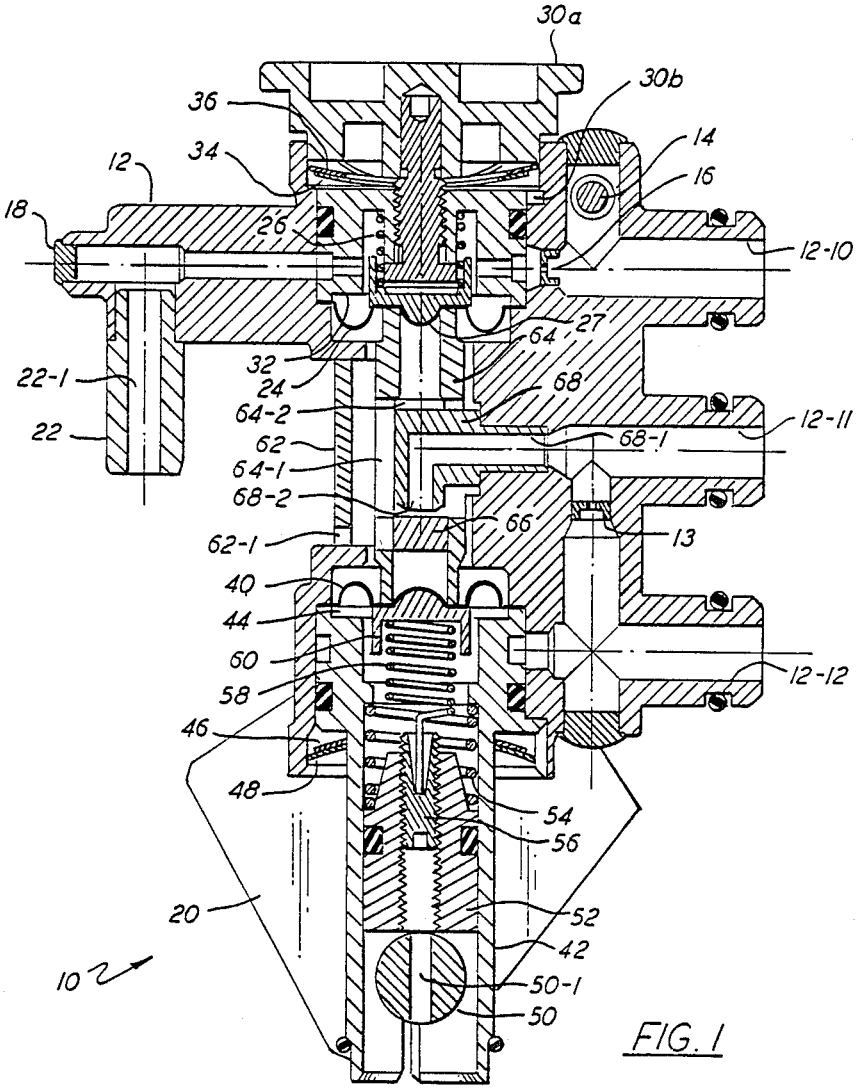
FIG. 1 is a sectional view of the air volume controller of the present invention.
Figure 3:
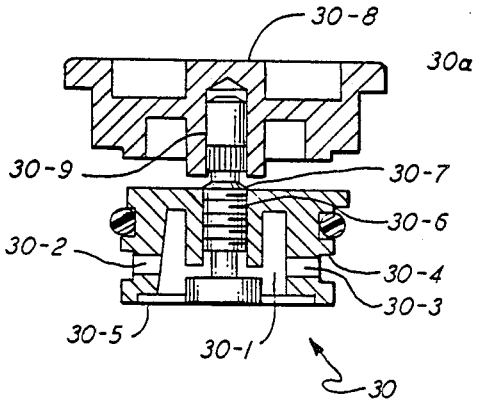
FIG. 3 is a sectional view of the low side plug.

Referring now to FIG. 1, plug 18 seals one end of bore 12-10. Orifice 16 is located in bore 12-10 between bores 12-2 and 12-14. Pipe 22 is received in bore 12-16 and defines a thermostat port. Low side diaphragm 24 is peripherally sealed between shoulder 12-8 and low side plug 30. Referring now to FIG. 3, plug 30 is made up of upper portion **30*a* and lower portion 30*b*. Lower portion 30*b* has an annular recess 30-1 formed therein. Spaced, diametrically located bores 30-2 and 3 extend radially outward from annular recess 30-1 to annular recess 30-4 so as to form a continuous passage with bore 12-10 in the assembled controller 10. Recess 30-5 is formed in the surface of lower portion 30*b* peripherally engaging diaphragm 24 to thereby define with diaphragm 24 a low pressure chamber 32. Threaded bore 30-6 is formed in lower portion 30*b* and threadably receives minimum flow adjusting screw 30-7 which serves to connect upper portion 30*a* and lower portion 30*b* together as a unit. Screw 30-7 is press fit into bore 30-9 of upper portion 30*a* so as to be integral therewith. Upper portion 30*a* defines minimum flow adjusting knob 30-8 which provides for field adjusting the position of lower portion 30*b* to thereby regulate the spring bias applied by low side spring 26 against low side spring cup 27 and to limit the movement of element 64 in the direction of plug 30. Plug 30 is held in bore 12-2 in engagement with the periphery of diaphragm 24 by the biasing force of wavy spring or washer 34 which is, in turn, held in place by spring retainer 36**.

Figure 4:
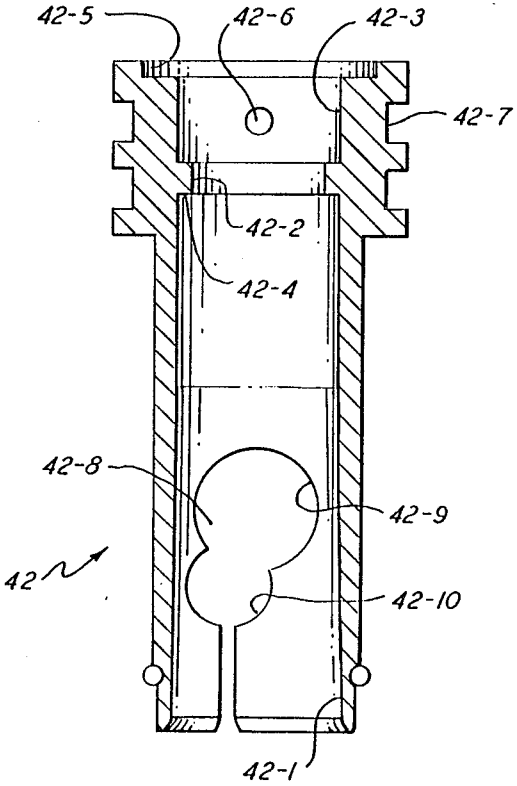
FIG. 4 is a sectional view of the high side plug.

High side diaphragm 40 is peripherally sealed between shoulder 12-9 and high side plug 42. As best shown in FIG. 4, plug 42 has a bore therein serially defined by bores 42-1 to 42-3. Shoulder 42-4 is formed between bores 42-1 and 42-2. Bore 42-3 terminates in recess 42-5 which is located opposite diaphragm 40 in the assembled controller to define therewith high pressure chamber 44. Diametral bore 42-6 provides fluid communication between annular groove 42-7 and bore 42-3. Plug 42 is held in bore 12-6 in engagement with the periphery of diaphragm 40 by the biasing force of wavy spring or washer 46 which is, in turn, held in place by spring retainer 48.

Figure 5:
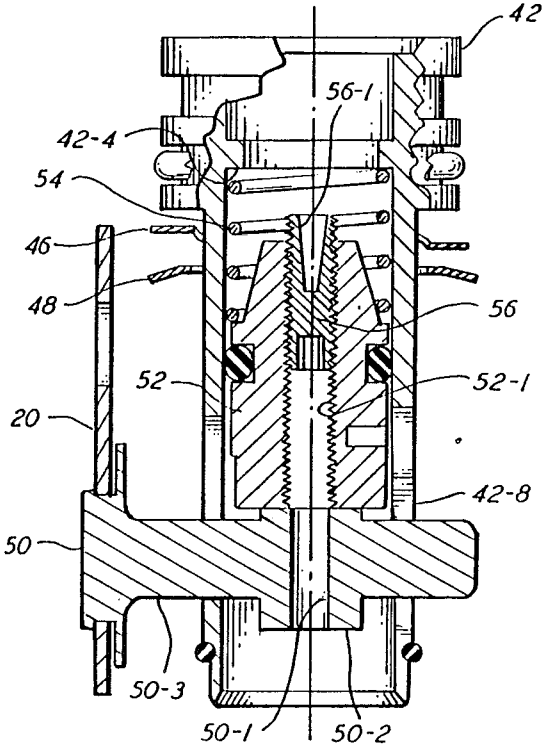
FIG. 5 is a partially sectioned view of the high side plug and cam assembly.

Referring now to FIGS. 1, 4 and 5, cam 50 is located in opening 42-8 which is transverse to bore 42-1. Opening 42-8 is made up of two intersecting circular openings 42-9 and 42-10. Circular opening 42-9 is larger to receive the cam member 50-2 of cam 50. After cam 50 is inserted in opening 42-9 it is then pushed down so that the shaft 50-3 is forced into and locked in the smaller opening 42-8. Cam member 50-2 has an axial bore 50-1 and adjustably positions cam follower 52 against the bias of cam follower spring 54 which seats on shoulder 42-4. Threaded axial bore 52-1 is formed in cam follower 52 and threadably receives spring adjuster 56. Spring adjuster 56 has an axial recess 56-1 which receives one end of spring 58 while the other end of spring 58 is received in high side spring cup 60 and forces spring cup 60 into engagement with diaphragm 40. Indicator 20 is secured to cam 50 and is rotated to a desired position indicated by indicia (not illustrated) to properly position the cam member 50-2 in accordance with the selected position.

Bore 12-4 is vented to the atmosphere via relieved portion 62-1 of removable cover 62. Tubular element 64 is located within bore 12-4 and is engaged at its respective ends by diaphragms 24 and 40. Transverse opening 64-1 is formed in element 64 and intersects axial bore 64-2. Plug 66 is press fit into the lower portion of bore 64-2 of element 64. Nozzle 68 is received in bore 12-11 and extends into bore 12-4. Bore 68-1 in nozzle 68 forms a continuous flow path with bore 12-11 and terminates in port 68-2 located in opening 64-1. The relative positions of port 68-2 and plug 66 defines a gap which dictates the resistance to flow from port 68-2 and the position of plug 66 is changed with movement of tubular element 64.

With air volume controller 10 assembled as shown in FIG. 1 and with cam 50 in the position shown in FIGS. 1 and 5, bores 50-1 and 52-1 provide access to spring adjuster 56 which may then be adjusted by a screw driver, allen wrench or the like extending through bores 50-1 and 52-1.

Figure 6:
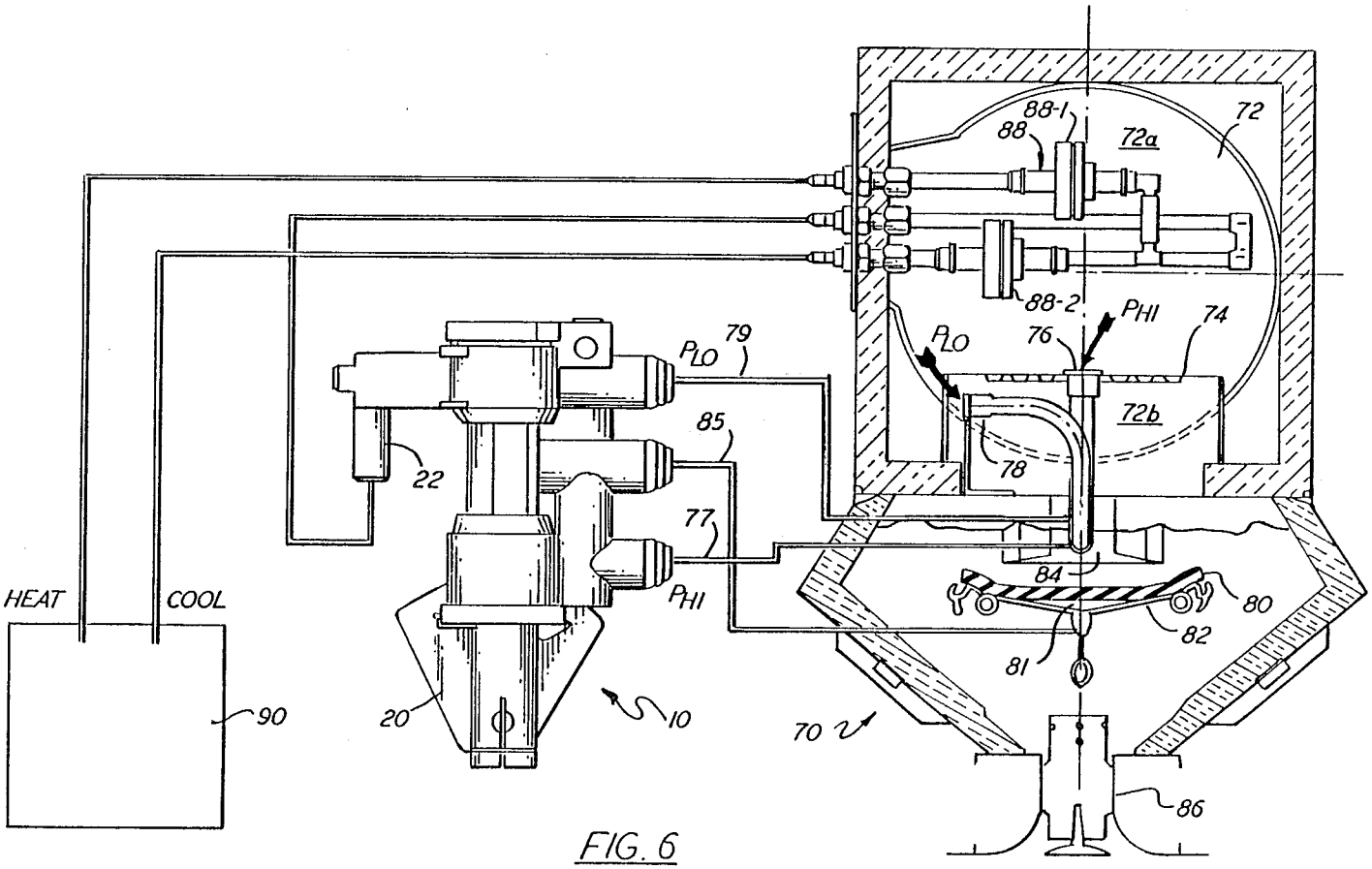
FIG. 6 is a schematic representation of a control system using the air volume controller of the present invention in a heating-cooling control with a variable air volume thermal changeover.

By thus threadably positioning spring adjuster 56, the tension of spring 58 can be factory adjusted to set the balance point by calibration to a specific point. The air volume controller 10 can then be connected to a terminal as shown in FIG. 6. Nozzle plate 74 divides plenum 72 into high and low pressure areas 72*a* and *b*, respectively. High pressure pickup 76 extends through nozzle plate 74 into high pressure area 72*a* and is connected via line 77 to the high pressure inlet port defined by bore 12—12. Low pressure pickup 78 is located within low pressure area 72*b* and is connected via line 79 to the low pressure inlet port defined by bore 12-10. Bellows 80 and retainer 82 coact to define a sealed chamber 81 whereby bellows 80 is positioned with respect to plenum outlet 84 responsive to the pressure in the chamber 81 for controlling the flow of air to diffuser 86. Chamber 81 is connected via line 85 to the bellows port defined by bore 12-11.

Depending upon the connection of pipe 22 whose bore 22-1 defines the thermostat port, the air volume controller 10 and terminal 70 can be operated in several modes. If the thermostat port is closed, as by a plug, a constant volume control will result while if the thermostat port is connected to a cooling only bleed thermostat a variable air volume control will be obtained. If, as illustrated in FIG. 6, the thermostat port is connected to a heating/cooling bleed thermostat 90 through a changeover valve 88, then a heating/cooling control with variable air volume thermal changeover is obtained. If the FIG. 6 arrangement is modified by replacing heating/cooling thermostat 90 with a cooling only bleed thermostat then a variable air volume control with warmup is obtained, and if a thermal warm up control is added, a variable air volume control with warm up will result.

Changeover valve 88 is a thermally actuated three-way valve which is an assembly of two two-way valves, 88-1 and 2, and directs the bleed signal from controller 10 to the proper portion of heating/cooling thermostat 90. When the temperature in plenum 72 is above the valve setpoints, the signal of controller 10 will be transmitted to the heating bimetal of the thermostat 90. Likewise when the temperature in plenum 72 drops below the setpoint, that signal will be transmitted to the cooling bimetal of the thermostat 90. For example, the heating bimetal will be in thermal control when the plenum air temperature is above 75° F. and the cooling bimetal will be in thermal control when the plenum air temperature is below 70° F. The changeover valve 88 is necessary in cooling/heating applications to prevent undercooling or over-heating. For example, with no changeover valves and with cold air being supplied, a drop in the temperature of the controlled space because of an outside temperature drop, for example, causes the cooling thermostat to close. The heating thermostat, however, sensing a need for heating would call for "heating" airflow and would cause cool air to flow into the zone further cooling it. The changeover 88 keeps the proper thermostat in control based upon the supply temperature.

The air volume controller 10 is thus fed with high pressure air, $P_{HI}$, via line 77 and low pressure air, $P_{LO}$, via line 79. The high pressure air communicates via bore 12-12, groove 42-7, bore 42-6 and bore 42-3 with high pressure chamber 44 where it acts against the lower side of diaphragm 40, as illustrated. Spring 58 also acts through spring cup 60 against the lower side of diaphragm 40. The biasing force supplied by spring 58 is a result of the position of spring 58 due to spring adjustment 56 and the position of cam follower 52 due to the position of cam member 50-2. The upper side of diaphragm 40 engages tubular element 64.

The balance point is set by increasing or decreasing the compression of spring 58. This spring is first set at calibration to a specific point, then at installation by adjusting cam 50. Cam 50 rotates and cam member 50-2 raises or lowers cam follower 52 which repositions spring 58. Rotating cam 50 to raise the cam follower results in a lower airflow setpoint because tubular element 64 and thereby plug 66 is pressed toward port 68-2 decreasing the gap and thereby the exhaust and thus increasing the bellows inflation. Lowering the cam follower 52 results in an increased airflow setpoint.

The low pressure air communicates via bore 12-10, orifice 16, annular recess 30-4, bores 30-2 and 3 and annular recess 30-1 with low pressure chamber 32 where it acts against the upper side of diaphragm 24, as illustrated. The lower side of diaphragm 24 engages tubular element 64 which is thus subject to a differential pressure which tends to move tubular element 64 accordingly. The pressure in low pressure chamber 32 is regulated by bleeding to atmosphere through bore 12-14 under the control of threaded adjusting screw 14 as well as subject to bleeding of air supplied via bore 12-16 to the bleed thermostat 90. The pressure in high pressure chamber 44 is communicated via bore 12-13 and orifice 13 with bore 12-11 which communicates via line 85 with chamber 81 for controlling the inflation and deflation of bellows 80. Additionally, bore 12-11 communicates with the atmosphere via bore 68-1 and port 68-2. The pressure differential acting across tubular element 64 causes its movement and that of the plug 66 which is carried by element 64. Plug 66 is located beneath port 68-2 which acts as a bleed nozzle which is thereby modulated responsive to the position of plug 66. The closer plug 66 is to port 68-2, the smaller will be the actual exhaust porting resulting in a greater flow resistance and a higher pressure in chamber 81 causing a closing of plenum outlet 84. As plug 66 moves away from port 68-2, the exhaust porting is increased resulting in a decrease in pressure in chamber 81 and an opening of plenum outlet 84. Orifice 13 acts as a balancing orifice for the coaction of plug 66 and port 68-2. The balancing of forces acting on tubular element 64 through diaphragms 24 and 40 at a control point coincident with the differential pressure across the nozzle plate 74 sets the relative positions of plug 66 and port 68-2 and thus the exhaust through port 68-2 and the pressure in chamber 81 which results in an air flow through terminal 70 consistent with the setpoint. A rise in pressure in high pressure plenum area **72*a* is thus communicated to bore 12-12 and ultimately to high pressure chamber 44 where it produces an increased differential across tubular element 64. This increased differential tends to move element 64 upwards causing plug 66 to close port 68-2 thereby raising the pressure in chamber 81 causing bellows 80 to inflate and move toward closing plenum outlet 84 until a pressure balance across element 64 is again achieved. This action maintains a constant airflow delivery through terminal 70. Similarly, a decrease in the pressure in high pressure plenum area 72*a* will result in a decrease in differential pressure across element 64 causing element 64 to move again and open port 68-2**.

When the thermostat port defined by pipe 22 is closed either by capping or by the applied thermostat bleed port being closed thermally, full low pressure acts on diaphragm 24. As the thermostat port defined by pipe 22 or the corresponding bleed thermostat opens, the pressure in chamber 32 is bled off allowing the effective differential pressure on element 64 to increase causing it to move toward port 68-2 thereby decreasing the exhaust flow and causing an increase in the pressure in chamber 81 which inflates bellows 80 and decreases the delivered unit airflow. As the thermostat port defined by pipe 22 approaches full open, the terminal 70 will continue to deliver decreased airflow. Minimum airflow adjusting screw 30-7 is positioned to restrict the movement of element 64 to thereby prevent plug 66 from completely closing port 68-2 and allowing air to bleed from chamber 81 so as to prevent terminal 70 from being completely shut off.

Although a preferred embodiment of the present invention has been illustrated and described, other changes will occur to those skilled in the art. It is therefore intended that the scope of the present invention is to be limited only by the scope of the appended claims.

What is claimed is:

1. A duct pressure powered air volume controller comprising:

housing means having first, second, third and fourth ports;

elongated movable means located within said housing means and having a first end which engages a first side of a first diaphragm and a second end which engages a first side of a second diaphragm;

a first chamber means formed in said housing means and partially defined by a second side of said first diaphragm;

a second chamber means formed in said housing means and partially defined by a second side of said second diaphragm;

spring means located in said second chamber means and biasing said second diaphragm against said second end of said elongated movable means;

first fluid path means connecting said first and fourth ports via said first chamber means and having a first orifice between said first port and said first chamber;

second fluid path means connecting said second port with nozzle means which discharges to ambient and which coacts with said elongated movable means to control the resistance to flow from said nozzle means;

third fluid path means connecting said third port with said second chamber means; and fourth fluid path means containing a second orifice and connecting said second and third flow path means.

2. The controller of claim 1 further including adjustable minimum airflow control means in said first fluid path between said first chamber means and said fourth port.

3. The controller of claim 1 further including adjustable bleed means connected to said first fluid path between said first port and said first orifice for adjustably bleeding air to ambient.

4. The controller of claim 1 further including first means for adjusting the bias of said spring means.

5. The controller of claim 4 further including second means for adjusting the bias of said spring means.

6. The controller of claim 1 further including an adjustable screw means located in said first chamber means for restricting movement of said elongated movable means.

7. An air distribution system comprising:

an air terminal unit including a plenum divided into high and low pressure areas having high and low pressure pickup means, respectively, and inflatable bellows means for controlling the flow of air from said plenum to a diffuser for discharge into a zone;

bleed thermostat means;

a duct pressure powered air volume controller including:

(a) housing means having a first port connected to said low pressure pickup means, a second port connected to said bellows means, a third port connected to said high pressure pickup means and a fourth port connected to said bleed thermostat means;

(b) elongated movable means located within said housing means and having a first end which engages a first side of a first diaphragm and a second end which engages a first side of a second diaphragm;

(c) a first chamber means formed in said housing means and partially defined by a second side of said first diaphragm;

(d) a second chamber means formed in said housing means and partially defined by a second side of said second diaphragm;

(e) spring means located in said second chamber means and biasing said second diaphragm against said second end of said elongated movable means;

(f) first fluid path means connecting said first and fourth ports via said first chamber means and having a first orifice between said first port and said first chamber whereby said first chamber is connected to said low pressure pickup means and to ambient via said bleed thermostat means;

(g) second fluid path means connecting said second port with nozzle means which discharges to ambient and which coacts with said elongated movable means to control the resistance to flow from said nozzle means which coacts with said elongated movable means to control the resistance to flow from said nozzle means and thereby the inflation and deflation of said bellows means;

(h) third fluid path means connecting said third port with said chamber means whereby said second chamber is connected to said high pressure pickup means; and (i) fourth fluid path means containing a second orifice and connecting said second and third flow path means whereby said high pressure pickup means can be connected to said bellows means.

8. The air distribution system of claim 7 wherein said controller further includes adjustable minimum airflow control means in said first fluid path between said first chamber means and said fourth port.

9. The air distribution system of claim 7 wherein said controller further includes adjustable bleed means connected to said first fluid path between said first port and said first orifice for adjustably bleeding air to ambient.

10. The air distribution system of claim 7 wherein said controller further includes first means for adjusting the bias of said spring means.

11. The air distribution system of claim 10 wherein said controller further includes second means for adjusting the bias of said spring means.

* * * * *